US005634947A

United States Patent [19]

Kazama

[11] Patent Number: 5,634,947

[45] Date of Patent: Jun. 3, 1997

[54] METHOD FOR CLEANING CLOTHES WITH PROPYLENE GLYCOL MONOMETHYL ETHER

[75] Inventor: Ken Kazama, Ashiya, Japan

[73] Assignee: Mihama Corporation, Tokyo, Japan

[21] Appl. No.: 4,522

[22] Filed: Jan. 14, 1993

Related U.S. Application Data

[63] Continuation-in-part of Ser. No. 765,584, Sep. 25, 1991, abandoned.

[30] Foreign Application Priority Data

Oct. 2, 1990 [JP] Japan ..... 2-263002

[51] Int. Cl.[6] ..... D06L 1/12

[52] U.S. Cl. ..... 8/137; 510/276; 510/365; 510/506

[58] Field of Search ..... 134/26, 12, 31; 252/162, 170; 8/137, 142; 510/276, 365, 506

[56] References Cited

U.S. PATENT DOCUMENTS

| | | | |
|---|---|---|---|
| 3,701,627 | 10/1972 | Grunewalder | 8/142 |
| 3,705,854 | 12/1972 | Gunning | 252/70 |
| 3,809,533 | 5/1974 | Sievenpiper | 8/609 |
| 4,272,423 | 6/1981 | Hirano et al. | 106/23 X |
| 4,336,024 | 6/1982 | Denissenko et al. | 8/142 |
| 4,493,781 | 1/1985 | Chapman et al. | 510/278 |
| 5,102,573 | 4/1992 | Han et al. | 134/19 |

FOREIGN PATENT DOCUMENTS

| | | |
|---|---|---|
| 63-112699 | 5/1985 | Japan . |
| 62-201977 | 9/1987 | Japan . |
| 63-20400 | 1/1988 | Japan . |
| 63-168498 | 7/1988 | Japan . |

OTHER PUBLICATIONS

Webster's Ninth New Collegiate Dictionary, 1986 p. 320.

*Primary Examiner*—Jill Warden
*Assistant Examiner*—Saeed Chaudhry
*Attorney, Agent, or Firm*—Frishauf, Holtz, Goodman, Langer & Chick, P.C.

[57] ABSTRACT

Disclosed is a method for cleaning clothes which comprises bringing the clothes into contact with a cleaning solvent, removing the contaminated solvent, rinsing and then drying the clothes, the improvement wherein said cleaning solvent consists of propylene glycol monomethyl ether containing 4 to 50% by volume of water.

5 Claims, No Drawings

METHOD FOR CLEANING CLOTHES WITH PROPYLENE GLYCOL MONOMETHYL ETHER

This is a continuation-in-part of application Ser. No. 07/765,584 filed Sep. 25, 1991 now abandoned.

BACKGROUND OF THE INVENTION

The present invention relates to a method for cleaning clothes.

The dry cleaning technique is intended to remove soil from clothes by the use of a nonaqueous solvent, but conventional dry cleaning agents have the following three problems regarding environmental pollution. The first problem is based on the fact that all the organic solvents such as perchloroethylene, 1,1,1-trichloroethane and CFC 113 which have been widely used contain chlorine. Such chlorine containing solvents pollute the environment and destroy the ozone layer, and so, it will soon be impossible, by regulation, to use these solvents. The second problem is the waste pollution of detergents. Organic solvent can effectively remove hydrophobic soils, but the use of solvent alone cannot exert a sufficient cleaning ability. Nowadays, in order to improve the cleaning ability, a small amount of water and a soap (a surface active agent) for dry cleaning are added to the solvent. The used solvent is forcedly cleaned by a pressure filter, and at this time, the soil which has been removed from the clothes and dissolved in the solvent are removed together with powder adsorbing this soil.

The cleaned solvent is returned to the cleaning machine. Finally, the contaminated solvent is distilled, and the resulting residue is discharged. This residue is disposed of as an industrial waste, but since it contains the organic solvent and the surface active agent, its disposal is extremely difficult. The third problem is water pollution by the solvent caused by disposing water containing the solvent in the sewer system.

The present inventor has previously investigated the dry cleaning capabilities of 81 kinds of solvents [Journal of the Japan Research Association for Textile End-use, 27, 8, pp. 352–359 (1986)], but there has not been any solvent which can meet all requirements.

The solvent for dry cleaning must meet several requirements such as influence on the environment, detergency, handleability, safety, etc. Detergency is affected by the "solubility" and "dispersibility" of various types of soils, including oil-soluble soils such as skin oils, fat and oil, oil mist, etc.; water-soluble soils such as sweat, water-soluble foods, etc.; dirts such as sludge, dust, etc.; the degree of the "counter-contamination", or soils washed from clothes that migrate back from the cleaning liquid to the clothes; and the degree of surface tension of the solvent which penetrates into the clothes and between the soils. On the other hand, the "handleability" of the solvent is determined by the ease of drying the washed articles, the length of the solvent life, the pass of distillation and recovery of the solvent, suitability for machines with no corrosion of metal, its workability and management with low odor, no remaining odor in the washed articles, etc. Furthermore, the "safety" of the solvent is determined by the shape retention of the washed articles, denaturation of the washed articles including yellow discoloration, the decrease of gloss, the run-off of dye, the dissolution of auxiliary items such as buttons, cores and lames, as well as high ignition point and flash point, low toxicity, etc.

Propylene glycol monomethyl ether (hereinafter referred to as "PM") is known in the art as a detergent for home use (Japanese Unexamined Patent Publication No. 20400/1988), a detergent for floor use (Japanese Unexamined Patent Publication Nos. 112699/1988 and 168498/1988), a detergent for ink (Japanese Unexamined Patent Publication No. 73899/1990), and a letter-erasing liquid for erasing letters printed on clothes which is used together with a reducing or an oxidizing bleaching agent, but it is not yet known in the art that PM is used as a solvent for the dry cleaning of clothes.

The present invention is directed to a method which can solve all the problems of the above-mentioned conventional solvents, can completely achieve the inherent purpose of cleaning, and can prevent cleaning troubles.

SUMMARY OF THE INVENTION

The present invention is directed to a cleaning method which comprises the steps of bringing clothes to be cleaned into contact with a mixed solvent comprising 4 to 50% by volume, preferably 4 to 25% by volume, of water and PM, removing the contaminated solvent from the cleaned clothes, and then rinsing, squeezing and drying the clothes.

DESCRIPTION OF THE PREFERRED EMBODIMENTS

The cleaning method of the present invention can be carried out by substituting a mixed solvent of PM and water for a conventional solvent and utilizing a conventional dry cleaning machine. For the practice of the cleaning method of the present invention, a dry cleaning machine is used in which a closed and fixed outside drum and a rotatable double cylindrical inside drum are arranged laterally.

First, clothes are put in the inside drum, and the outside drum is then covered with a lid. A solvent is then jetted to the clothes. The clothes immersed in the solvent are churned by the rotation of the inside drum to create a mechanical cleaning function.

Cleaning time is about 20 minutes, as in the case of perchloroethylene. Since PM has a specific gravity smaller than that of perchloroethylene (the specific gravity of PM=0.92, and that of perchloroethylene=1.32), impact on the clothes is small, when the clothes containing the solvent drop within the inside drum onto the liquid surface below, so that the mechanical damage to the clothes is slight.

Furthermore, PM has less power to dissolve resins and dyes than perchloroethylene, and when PM is used, the mechanical function is also mild as described above. Therefore, such troubles as damage to auxiliary items and dyes can be inhibited.

Rinsing is carried out in a step in which the clothes are washed again with a soil-free solvent. In the rinsing step, a long period of time has heretofore been necessary to remove soap. In the present invention, however, the mixed solvent of PM and water does not require any soap, and therefore the rinsing time is about 5 minutes. This is about ⅓ the rinsing time necessary when perchloroethylene is used.

Drying is carried out for about 20 minutes by feeding hot air having an inlet temperature of about 60° C. However, the PM and water mixture has a larger specific heat and evaporation latent heat than perchloroethylene, and so it is necessary to increase the volume of the hot air (the specific heat of PM=0.58 and that of perchloroethylene=0.21; and the evaporation latent heat of PM=102.0 and that of perchloroethylene=50.1).

After completion of the drying, the clothes are taken out and finished, with which the cleaning operation is terminated.

In the cleaning process, a filter is used to remove solid soils from the solvent. This filter can be a cartridge type filter made of a glass fiber or a nonwoven fabric and can be used repeatedly by periodic washing with water.

The soils dissolved in the solvent are removed as a residue. That is, PM and water are evaporated in the last step by an evaporator, and the resulting residue is thrown away. The residue is a solution containing the soils at a high concentration. The residue is free from any soap and powder (diatomaceous earth) in contrast to the residue produced by the use of conventional solvent, and therefore, only an extremely small amount of the residue is formed. In addition, since PM does not contain any chlorine, it is easy to dispose of the residue as a waste.

As will be established by the various tests described below, the cleaning method of the present invention has excellent advantages.

TEST EXAMPLE 1 (SOLUBILITY)

Water, perchloroethylene, 1,1,1-trichloroethane, CFC 113 and PM were used as solvents. Solutes used with a distillation residue from a dry cleaning factory, which was used as an oil-soluble soil, and instant coffee powder, which was used as a water-soluble soil. The test was conducted by adding 5 ml of each solvent to 0.5 g of each solute in a test tube, allowing the mixture to stand at 30° C. for 72 hours, and then inspecting solubility with the naked eye.

TABLE 1

| Solute | Water | Perchloro-ethylene | 1,1,1-tri-chloro ethane | CFC 113 | PM |
|---|---|---|---|---|---|
| Oil-soluble | x | o | o | o | o |
| Water-soluble | o | x | x | x | Δ |

o: well dissolved, Δ: dissolved, and x: not dissolved.

It is apparent from the results in Table 1 that PM has both soil cleaning capabilities for both oil soluble and water soluble soils. PM is as effective on the oil-soluble soils as a conventional solvent and exhibits relatively good properties with water-soluble soils, although it is inferior to water. With a conventional chlorine-based solvent, a soap is used as an auxiliary so as to enhance dissolving performance for water-soluble soils, but PM exhibits good detergency for water-soluble soils even without soap. Furthermore, PM has a surface tension of 27.7, which is greater than those of petroleum (18–19) and CFC 113 (17.3) and which is comparable to those of perchloroethylene (32.3) and trichloroethane (25.6).

With the afore-mentioned results, it becomes apparent that conventional solvent cannot dissolve water-soluble soils such a soy sauce, coffee and the like, but PM or PM with added water can dissolve these water-soluble soils. Thus, a soap for dissolving water-soluble soils is not necessary. As a result, it is possible to save soap costs and the trouble of regulating the amount of soap to shorten rinse time, and to decrease the amount of waste. In addition, PM with added water can disperse and remove solid particles (e.g., earth, sand and dust) which cannot be removed by conventional dry cleaning.

TEST EXAMPLE 2 (COUNTER-CONTAMINATION)

A solvent which effects less counter-contamination (the phenomenon in which soils washed from clothes migrate back from the cleaning liquid to the hydrophobic surfaces of the clothes) provides a good cleaning finish and permits the washing of clothes even when the liquid contains a large amount of soils. Thus, distillation is not required so often, which is economical.

The degree of counter-contamination depends upon the combination of soils (solutes), the type of solvent and the types of clothes. In this test example, soy sauce (0.5 ml) and coffee (0.5 g) were used as water-soluble solutes, carbon black (0.04 g) was used as a dispersible solute, a waste oil (2 g) which was employed as a gear oil for a long period of time was used as an oil-soluble solute, and dry cleaning distillation residue (0.04 g) was used as a miscible solute. The test was conducted by putting a 2.5 cm×2.5 cm cloth strip in 75 ml of a solvent in which each solute is dissolved, stirring and then immersing it therein for 5 minutes. After air drying, the reflectance of each cloth strip was measured by UV-200, and a counter-contamination ratio was calculated from the following equation:

$$\text{Counter-contamination ratio (\%)}=(A-B)/C\times 100$$

wherein

A: the reflectance of the original cloth

B: the reflectance of the cloth strip after immersion, and

C: the reflectance of the original cloth.

The results are shown in Table 2.

TABLE 2

| Solute | Clothing | Water | Perchloroethylene | 1,1,1-Trichloroethane | CFC-113 | PM |
|---|---|---|---|---|---|---|
| Soy Sauce | Cotton | 2.57 | * | * | * | 8.75 |
| | Wool | 5.67 | 0.01 | 6.16 | 0.001 | 4.25 |
| | Polyester | 3.85 | 1.98 | 11.07 | 4.40 | 5.93 |
| Coffee | Cotton | 29.67 | 4.08 | 1.37 | 6.30 | 2.19 |
| | Wool | 22.86 | 21.87 | 5.18 | 32.04 | 2.08 |
| | Polyester | 11.95 | 4.56 | 6.39 | 4.29 | 4.87 |
| Carbon black | Cotton | 65.55 | 43.42 | 38.41 | 61.51 | 33.52 |
| | Wool | 44.31 | 60.90 | 50.53 | 69.98 | 47.08 |
| | Polyester | 53.02 | 42.41 | 42.74 | 50.25 | 64.92 |
| Waste oil | Cotton | 8.73 | 3.14 | 2.77 | 5.58 | 3.07 |
| | Wool | * | 3.29 | 2.38 | 6.94 | * |
| | Polyester | * | 2.22 | 2.99 | 2.39 | * |
| Distillation residue | Cotton | 7.16 | 11.18 | 13.05 | 11.05 | 8.09 |
| | Wool | 5.44 | 12.03 | 13.46 | 12.30 | 9.79 |
| | Polyester | 3.33 | 5.50 | 6.44 | 5.29 | 5.81 |

*article heavily soiled by solute

The results in Table 2 indicate the following facts.

Soy sauce: In the chlorine-based solvent, soy sauce precipitated and floated in a sol state. This sol was hydrophilic and therefore firmly adheres onto cotton, which has a hydrophilic surface. It did not adhere to wool and polyester, which have hydrophobic surfaces. On the other hand, since the soy sauce was completely dissolved in water and PM, neither dyeing nor counter-contamination was observed.

Coffee: In the chlorine-based solvent and PM, the solute floated in a fine solid particle state. The particles selectively adhered to wool in perchloroethylene and CFC 113. They did not adhere thereto in trichloroethane and PM. On the other hand, in water, dyeability was noticeable.

Carbon black: In every solvent, carbon black dispersed instead of dissolving, and there was not any significant difference among the solvents.

Waste oil: This was completely dissolved in the chlorine-based solvent, and no counter-contamination was present. On the other hand, in water and PM, the oil floated in a sol state, and since this sol was hydrophobic, it adhered to the wool and polyester which have hydrophobic surfaces.

Distillation residue: This was a mixture of three water-soluble, dispersible and oil-soluble solutes which, further, contained a soap for charge. Therefore, this distillation residue was considered to be close to actual dry cleaning residue. Noticeable counter-contamination on the wool and cotton was seen in the chlorine-based solvent, but little was seen in water. In PM, the behavior of the residue was between that in water and in the chlorine-based solvent.

As described above, counter-contamination which cannot be rectified by the use of conventional nonaqueous solvent can be prevented by the use of PM, and thus an excellent finish can be obtained. It is to be noted that the counter-contamination takes place when the selected solvent is hydrophobic, and hence, no counter-contamination occurs in the hydrophilic PM.

TEST EXAMPLE 3 (SHRINKABILITY)

A feature of dry cleaning is that whereas water-absorbable fibers swell during water washing, using solvent, washed articles can be prevented from shape loss or shrinking. In this test, the shrinkage ratio of clothes washed in PM was inspected.

Into a laundermeter cup in which 10 steel balls and 100 ml of solvent were placed, 12 cm×12 cm test cloths made of cotton, hemp and wool and having a 10 cm×10 cm thread mark were added one by one, and then immersed in the solvent at room temperature for 45 minutes. After being air-dried, the length between the thread marks of each cloth was measured. The results are shown in Table 3.

TABLE 3

| | | PM 100% | PM 75% + Water 25% | PM 50% + Water 50% |
|---|---|---|---|---|
| Cotton | Warp (cm) | 10.00 | 10.00 | 10.00 |
| | Weft (cm) | 9.95 | 9.95 | 9.90 |
| Hemp | Warp (cm) | 10.00 | 10.00 | 10.00 |
| | Weft (cm) | 10.00 | 9.95 | 9.95 |
| Wool | Warp (cm) | 10.00 | 10.00 | 10.00 |
| | Weft (cm) | 9.90 | 9.80 | 9.80 |

The results in Table 3 indicate that even when PM is mixed with 50% water, the shrinkage ratio of the cotton weft is as small as 1%, and when PM is mixed with 25% water, the shrinkage ratio of the cotton weft is only 0.5%. These results are due to the good hydratability of PM. With 1,1,1-trichloroethane or perchloroethylene, water in the articles to be washed transfers to the solvent, but this water is not hydrated in the solvent and causes the washed articles to shrink. In the case of PM, however, the articles do not shrink, as shown in Table 3.

A small amount of water is dissolved in conventional solvent (0.01% by weight), and water which is not dissolved therein is adsorbed by fibers. As a result, the fibers swell, which causes the shape loss of the washed articles to lose their shape. To prevent this phenomenon, the water has been heretofore separated and discharged, which causes sewage pollution. On the other hand, PM can dissolve large amounts of water. Added water is dissolved in PM, and therefore, fibers do not swell directly. Since the water does not cause the fibers to swell, it is not necessary to remove it, and so sewage pollution by the discharge of water is prevented.

TEST EXAMPLE 4 (READINESS OF DRYING)

In a dry cleaning process, if a great amount of time is required to dry washed articles, work efficiency is markedly lowered. A test was conducted by piling 4 cotton cloths having a size of 5×5 cm, dropping 0.125 g of each solvent on the cloths, and then measuring the vaporization rate of the solvent. When the vaporization rate of perchloroethylene is regarded as 1, the other solvents had vaporization rates shown in Table 4.

TABLE 4

| | Perchloro-ethylene | Trichloro-ethane | CFC 113 | PM |
|---|---|---|---|---|
| Use of Cotton Cloth | 1 | 3.929 | 14.643 | 0.386 |
| Solvent Alone | 1 | 4.444 | 13.667 | 0.244 |

The vaporization rate of PM is low, but the reason that PM is suitable for cleaning is that PM has the lowest boiling point (120° C.) in the glycol ether series and, so, is easy to dry. In this connection, the boiling point of PM is close to that of perchloroethylene, i.e., 121° C. When a solvent having a higher boiling point than this is used, high temperature must be maintained for a long period of time for drying, which increases cost and chemically damages fibers or auxiliary items of the clothes. For example, the boiling point of propylene glycol monomethyl ether acetate is 132° C., and that of ethylene glycol monoethyl ether is 136° C. Such compounds with the high boiling points are no longer suitable for the drying step of dry cleaning.

TEST EXAMPLE 5 (COMBUSTIBILITY)

The flash point of PM is in the range of 36° to 38° C., and PM is substantially identical with a petroleum solvent in combustion readiness. However, when 50% water was added to PM, the flash point of the resultant mixture ranged from 62° to 64° C. Thus, it is apparent that mixing the solvent with water can lead to the elevation of the flash point.

TEST EXAMPLE 6 (CORROSIVENESS)

1 cm×2 cm test pieces of iron, aluminum and stainless steel were immersed in solvent at room temperature for one week, and then removed. The test pieces were allowed to stand in air for 3 months, and the degree of oxidation was evaluated. With regard to the test pieces immersed in PM, no change was observed.

The mixed solvent of PM and water according to the present invention has the following advantages as a solvent for cleaning.

(1) Since the mixed solvent contains no chlorine, it does not have a bad influence on the emvironment.

(2) The mixed solvent is effective in washing off both oil-soluble and water-soluble soils.

(3) The mixed solvent has less counter-contamination.

(4) The mixed solvent does not require any soap.

(5) The life of the mixed solvent is long.

(6) The mixed solvent does not corrode the cleaning machine, etc.

I claim:

1. A method for cleaning clothes which comprises bringing the clothes into contact with a cleaning solvent, removing the contaminated solvent, rinsing and then drying the clothes, the improvement wherein said cleaning solvent consists of propylene glycol monomethyl ether containing 4 to 50% by volume of water.

2. The method according to claim 1 wherein said solvent consists of propylene glycol monomethyl ether containing 4 to 25% by volume of water.

3. The method of claim 1 wherein said clothes contain soy sauce and the soy sauce is removed.

4. The method of claim 1 wherein said clothes contain coffee and the coffee is removed.

5. The method of claim 1 wherein said clothes contain waste oil and the waste oil is removed.

* * * * *